US011371657B2

(12) United States Patent
Bouron et al.

(10) Patent No.: US 11,371,657 B2
(45) Date of Patent: Jun. 28, 2022

(54) HYDROPACK SYSTEM

(71) Applicant: Plastic Omnium Advanced Innovation and Research, Brussels (BE)

(72) Inventors: Corentin Michel Roger Bouron, Rillieux-la-Pape (FR); Bjorn Criel, Sint-Martens-Lennik (BE); Eric Deparis, Levallois-Perret (FR)

(73) Assignee: PLASTIC OMNIUM NEW ENERGIES FRANCE, Lyons (FR)

( * ) Notice: Subject to any disclaimer, the term of this patent is extended or adjusted under 35 U.S.C. 154(b) by 272 days.

(21) Appl. No.: 16/496,989

(22) PCT Filed: Mar. 28, 2018

(86) PCT No.: PCT/EP2018/057967
§ 371 (c)(1),
(2) Date: Sep. 24, 2019

(87) PCT Pub. No.: WO2018/178173
PCT Pub. Date: Oct. 4, 2018

(65) Prior Publication Data

US 2020/0018443 A1 Jan. 16, 2020

(30) Foreign Application Priority Data

Mar. 30, 2017 (EP) ..... 17305378

(51) Int. Cl.
*F17C 13/04* (2006.01)

(52) U.S. Cl.
CPC ..... *F17C 13/04* (2013.01); *F17C 2205/0138* (2013.01); *F17C 2205/0332* (2013.01);
(Continued)

(58) Field of Classification Search
CPC ..... F17C 13/04; F17C 2205/0138; F17C 2205/0332; F17C 2205/0335;
(Continued)

(56) References Cited

U.S. PATENT DOCUMENTS 2,006,393 A * 7/1935 Hapgood ..... B67C 3/30 137/122
3,719,196 A * 3/1973 McJones ..... F17B 1/12 137/110
(Continued)

FOREIGN PATENT DOCUMENTS

CN 204573572 U 8/2015
CN 106122768 A 11/2016
(Continued)

OTHER PUBLICATIONS

International Search Report dated Jun. 29, 2018 in PCT/EP2018/057967 filed on Mar. 28, 2018.

*Primary Examiner* — Timothy L Maust
*Assistant Examiner* — James R Hakomaki
(74) *Attorney, Agent, or Firm* — Oblon, McClelland, Maier & Neustadt, L.L.P.

(57) ABSTRACT

The invention is related to a tank system for storing a high pressure gas. The invention provides a system for storing a gas, the system comprising at least two tanks, a first tank and a last tank, the first tank comprising an inlet port connected to a system inlet, the last tank comprising an outlet port connected to a system outlet, each tank being provided with an on tank valve comprising an inlet port, an outlet port, and a communication line leading into the tank, each on tank valve comprising a communication line between the inlet port and the outlet port of the on tank valve, the outlet port of the on tank valve of the first tank being connected to the
(Continued)

inlet port of the on tank valve of the last tank, the at least two tanks being serially connected.

8 Claims, 4 Drawing Sheets

(52) U.S. Cl.
CPC ..... *F17C 2205/0335* (2013.01); *F17C 2205/0338* (2013.01); *F17C 2205/0341* (2013.01); *F17C 2221/012* (2013.01); *F17C 2221/033* (2013.01); *F17C 2270/0184* (2013.01)

(58) Field of Classification Search
CPC ..... F17C 2205/0338; F17C 2205/0341; F17C 2221/012; F17C 2221/033; F17C 2270/0184; F17C 2223/0123; F17C 7/00; F17C 5/06; Y02E 60/32
USPC ..... 220/581
See application file for complete search history.

(56) References Cited

U.S. PATENT DOCUMENTS 3,863,664 A * 2/1975 Holbrook ..... A61M 1/0001 604/320
4,384,580 A * 5/1983 Leviton ..... A61M 1/604 604/323
4,682,627 A * 7/1987 Cooper ..... F17C 7/00 137/572
5,421,162 A * 6/1995 Gustafson ..... F17C 9/02 123/525
6,202,707 B1 3/2001 Woodall et al.
7,311,116 B2 * 12/2007 Lillis ..... H01M 8/04649 137/256
7,426,935 B2 9/2008 Schwan et al.
8,586,258 B2 * 11/2013 Maier ..... H01M 8/04208 429/444
8,899,278 B2 * 12/2014 Cohen ..... F17C 7/02 141/4
2002/0014227 A1 * 2/2002 Girouard ..... G05D 7/0106 123/527
2003/0160201 A1 * 8/2003 Sugiura ..... F17C 13/04 251/144
2006/0168999 A1 * 8/2006 Fisher ..... F17C 5/06 62/606
2007/0000561 A1 1/2007 Handa
2007/0031325 A1 * 2/2007 Carruthers ..... C01B 6/00 423/658.2
2007/0068576 A1 * 3/2007 Fisher ..... F17C 5/06 137/455
2007/0246122 A1 * 10/2007 Handa ..... F17C 13/12 141/82
2008/0271796 A1 11/2008 Neumann et al.
2014/0124039 A1 * 5/2014 Bartlok ..... F15B 1/04 137/14
2016/0195219 A1 * 7/2016 Cort ..... F17C 5/06 141/4
2018/0138528 A1 * 5/2018 Komiya ..... H01M 8/04753

FOREIGN PATENT DOCUMENTS

EP 1 722 152 A2 11/2006
GB 1147396 4/1969
JP 4744285 B2 8/2011
JP 5919103 B2 5/2016
WO WO 00/36333 A1 6/2000
WO WO 2008/157242 A2 12/2008

* cited by examiner

HYDROPACK SYSTEM

TECHNICAL FIELD OF THE INVENTION

The invention is related to a tank system for storing a high pressure gas.

BACKGROUND OF THE INVENTION

Hydrogen is an interesting fuel for the automotive industry because it is a clean gas that can be used in an efficient manner to produce electricity in a fuel cell. In an automotive fuel cell application, the hydrogen fuel is stored in a high pressure tank system on the vehicle.

A problem with such system is the risk of explosion in the case of a rupture or a leak, as hydrogen is a dangerous gas. When the density of hydrogen is higher than 4%, it becomes flammable. The most dangerous place is closed space. E.g., if a leak occurs when a car is located in a garage, the hydrogen accumulates and the increased density causes a risk for explosion.

In order to reduce the risk of leakage, that may lead to an explosion, the document U.S. Pat. No. 7,426,935 (FIG. 1) proposes to store the hydrogen gas in at least two tanks in a master slave system for load sharing purposes, where the master tank has unidirectional control over at least one dependent tank, the tanks being connected in parallel. The master tank and the dependent tank are each provided with a shut-off valve in order to provide a low pressure differential, so that a rupture or a leak will activate an automatic closure of the shut-off valve.

However, as such system is connected in parallel, the master unit is connected to each dependent tank. Each connection to a dependent tank requires a T-junction, comprising three fittings. Each fitting is a potential risk of leakage, and each new connected tank requires three further fitting points, that must be monitored.

SUMMARY OF THE INVENTION

Thus, the invention proposes a system with tanks connected in series. In order to achieve a serial connection, each tank is provided with a dedicated valve, an on tank valve here called OT-valve, having two ports, an inlet port and an outlet port, the OT-valve being provided with a communication line between the inlet port and the outlet port.

Particular and preferred aspects of the invention are set out in the accompanying independent and dependent claims. Features from the dependent claims may be combined with features of the independent claims and with features of other dependent claims as appropriate and not merely as explicitly set out in the claim For this purpose, the invention provides a system for storing a gas, preferably in a vehicle, the system comprising at least two tanks, a first tank and a final tank or, in other word, a last tank, the first tank comprising an inlet port connected to a system inlet, the last tank comprising an outlet port connected to a system outlet, each tank being provided with an OT-valve comprising an inlet port, an outlet port, and a communication line leading into the tank, each OT-valve comprising a communication line between the inlet port and the outlet port of the OT-valve, the outlet port of the OT-valve of the first tank being connected to the inlet port of the OT-valve of the last tank, the at least two tanks being serially connected.

According to a further embodiment, the system comprises at least one further tank connected between the first tank and the last tank. The further tank is provided with an OT-valve comprising an inlet port, an outlet port, and a communication line leading into the tank, each OT-valve comprising a communication line between the inlet port and the outlet port of the OT-valve, the inlet port of each tank being connected to outlet port of a previous tank, all tanks being serially connected.

The system according to the invention can be used for storing natural or hydrogen gas.

At least one OT-valve in the system according of the invention may comprise at least one shut-off valve and one check-valve that are connected in parallel and link the inlet port and the outlet port to the inside of the tank to which the OT-valve belong. The function of the shut-off valve is to open and close a line leading out of the tank. The check-valve enables the flow of the fuel only in the downstream direction from the connection line into the tank.

According to a further embodiment comprises at least one pressure regulator is connected on the line inside the last tank connected to the fuel receiving unit.

According to another embodiment at least one pressure regulator built in in the OT-valve of the last tank and connected in series with the shut-off valve in the OT-valve of the last tank.

The pressure regulator reduces the pressure between the last tank and the fuel using unit. An advantage of providing a pressure regulator inside the last tank or built-in in the OT-valve is that the amount of fitting is further reduced and thus the risk of leakage.

According to a further embodiment of the invention, at least one OT-valve comprises at least one of the following components: an excess flow valve, a filter, a safety venting device, a sensor in order to improve the performance of the OT-valve.

According to a further embodiment of the invention, at least one OT-valve used in the system according to the invention is provided with a first and a second communication line leading into the tank. By having several lines leading into the tank further functionalities may be added.

According to one embodiment of the invention the fuel using unit is a fuel cell tank A man skilled in the art understands that the tanks may be of different sizes.

Further embodiments of the invention comprise only two tanks or more than three tanks.

The above and other characteristics, features and advantages of the present invention will become apparent from the following detailed description, taken in conjunction with the accompanying drawings, which illustrate, by way of example, the principle of the invention. The description is given for the sake of example only, without limiting the scope of the invention. The reference figures quoted below refer to the attached drawings.

DETAILED DESCRIPTION OF THE DRAWINGS

Figure 1:
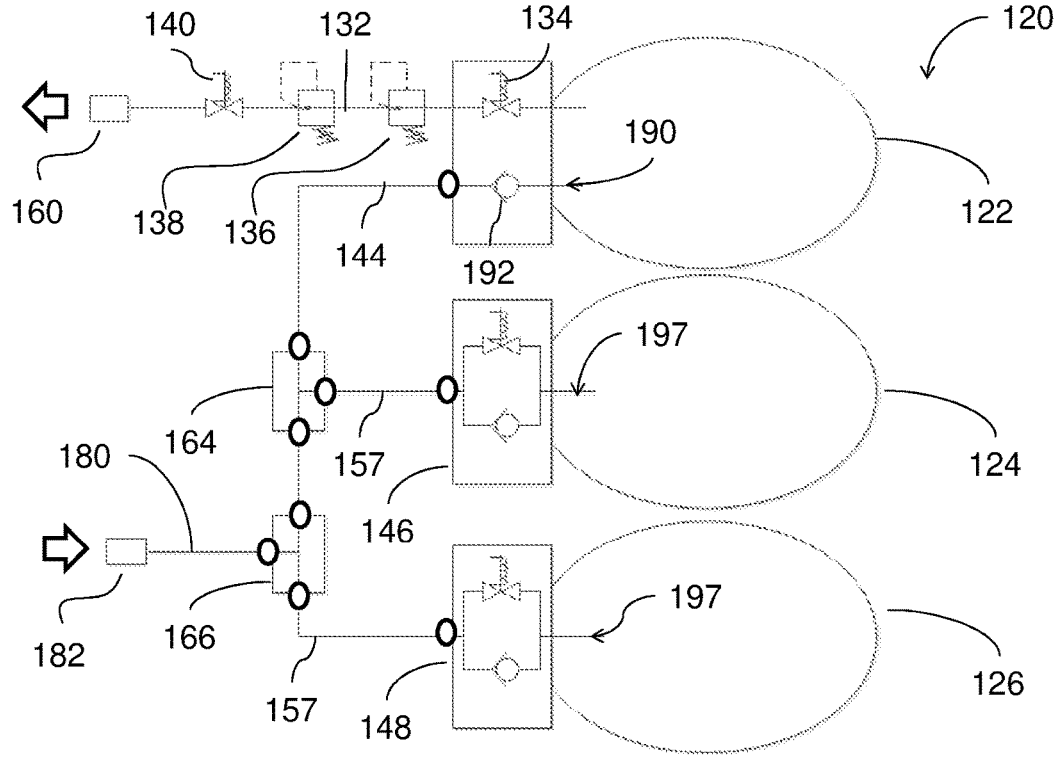
Fig. 1 Prior Art
FIG. 1 illustrates a fuel tank system according to the prior art.

The present invention will be described with respect to particular embodiments and with reference to certain drawings but the invention is not limited thereto but only to the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

It should be understood that the expression "a device A connected to a device B" should not be limited to devices or systems wherein an output of device A is directly connected to an input of device B. It means that there exists a path between an output of A and an input of B which may be a path including other devices or means.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

FIG. 1 is a schematic plan view of a fuel tank system 120 according to prior art. Here the term downstream designate the flow direction of the fuel. The term upstream designates the opposite direction. The system 120 comprises a master tank 122, a first dependent tank 124 and a second dependent tank 126. The master tank 122 is by means of a connection line 144 and lines 157 connected in parallel with the first dependent tank 124 and the second dependent tank 126. The connection line 144 is also connected to a refilling unit 182 by means of a refueling line 180 that provides fuel to the tank system 120. The master tank 122 is by means of a supply line 132 connected to a fuel using unit 160, e.g. a fuel cell.

The master tank 122 is provided with a shut-off valve 134 and a check-valve 192. The shut-off valve 134 is connected to the supply line 132 that is connected to a fuel using unit 160, e.g. a fuel cell. The function of the shut-off valve 134 is to open and close the supply line 132. The check-valve 192 is connected between the master tank 122 and the connection line 144 and enables the flow of the fuel only in the downstream direction from the connection line 144 into the master tank 122.

Figure 3:
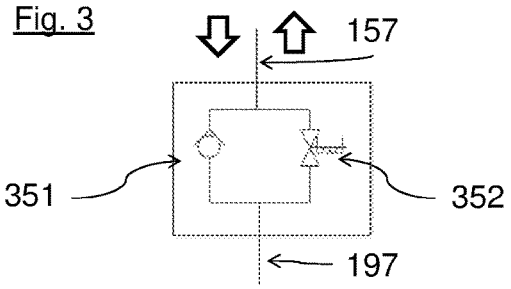
FIG. 3 shows an OT-valve used in the fuel tank system illustrated in FIG. 1.

The first dependent tank 124 is provided with an OT-valve 146 of the type illustrated in FIG. 3 comprising a shut-off valve and a check-valve, that are connected in parallel, and provided with one port for input and output to the first dependent tank 124. The second dependent tank 126 is also provided with an OT-valve 148 of the type illustrated in FIG. 3. The function of the dependent tanks 124, 126 is to feed the master tank in order to stabilize the pressure in all three tanks (122, 124,126).

A first and a second pressure regulator 136 and 138 are positioned on the supply line 132 between the master tank 122 and the fuel using unit 160. The function of the pressure regulators is to step down the gas pressure from the master tank 122 in two steps. A low pressure shut-off valve 140 is positioned downstream of the second regulator 130 on the supply line 132.

The refueling line 180 is connected to the connection line 144 by means of a T-fitting 166. The connection line 144 is also by means of the T-fitting 164 connected to the line 190 that enables the refueling of the master tank 122, without using the supply line 132. The line 190 is connected to the check-valve 192 that prevents the flow of the hydrogen gas from the master tank 122 to flow through the line 190. The OT-valve 146, 148 of each dependent tank 124, 126 is by means of a line 157 for inlet and outlet of fluid connected to the connection line 144. A line 197 connects each OT-valve 146, 148 to its corresponding dependent tank 124, 126.

The upstream side of the shut-off valve 134 is at the same pressure as the master tank 122. The downstream side of the shut-off valve 134 is at a significantly lower pressure and could even be at the atmospheric pressure. Thus, there is a large differential pressure across the shut-off valve 134. Therefore, a significant level of electrical energy is required to maintain the shut-off valve 134 in an open position. The system 120 according to prior art requires thus a large number of pressure sensors, temperature sensors, hydrogen sensors etc. in order to determine if a leak has occurred e.g. in the supply line 132 between the master tank 122 and the fuel using unit 160, e.g. a fuel cell. When a leak occurs, the valve is automatically shut-off. The system 120 according to prior art comprises means (not shown) that are adapted to shut-off the master tank 122, when a leak occurs The hydrogen gas from the master tank 122 is output on the supply line 132 to the fuel using unit 160. Due to the fact that the dependent tanks are connected in parallel, the pressure on both sides of the valves (146, 148) is about the same as the pressure in the three tanks, e.g. 700 bars. Thus, the differential pressure across the valves 146 and 148 is low and a minimum of electric energy is required to maintain the valves 146 and 148 in an open position.

Figure 2A:
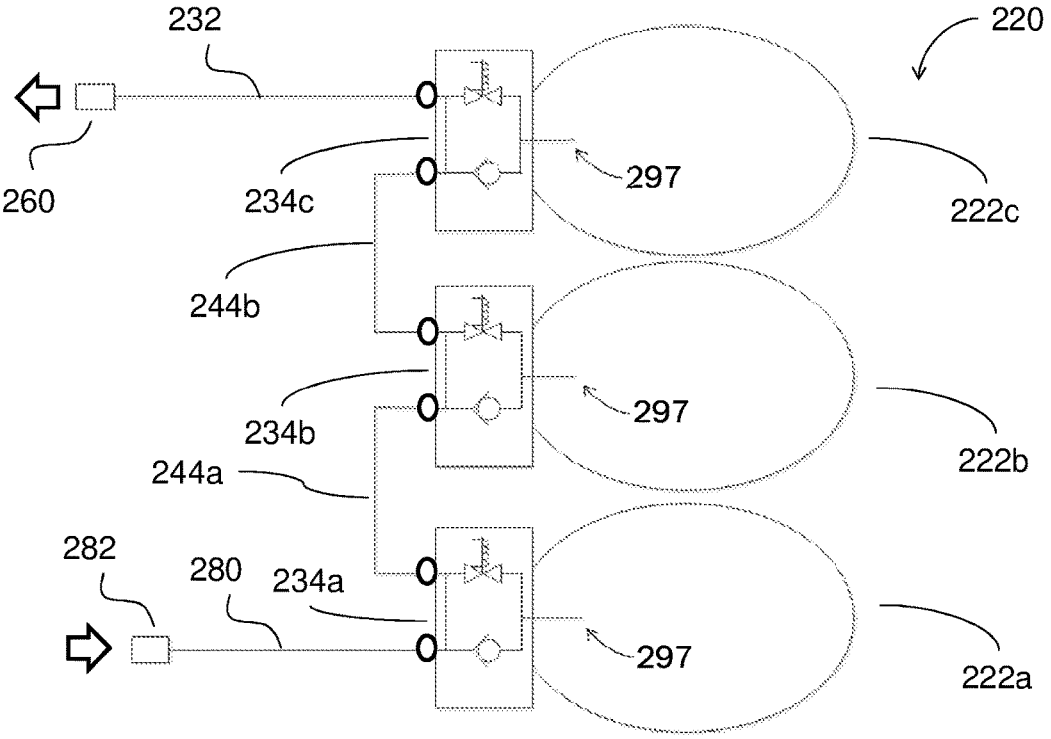
FIG. 2A illustrates a fuel tank system according to the invention.
Figure 4:
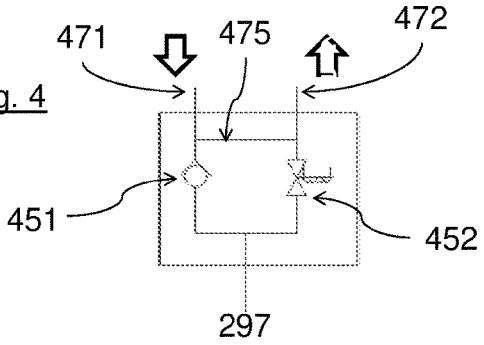
FIG. 4 shows an OT-valve used in a fuel tank system according to the invention.

FIG. 2A illustrates a plan view of a system 220 according to the invention comprising three tanks, a first tank 222*a*, a second tank 222*b*, a last tank 222*c*, each provided with an OT-valve, a first OT-valve 234*a*, a second OT-valve 234*b*, a last OT-valve 234*c* of the type illustrated in FIG. 4. The OT-valve used for the system according to the invention differs from that used in prior art in that it is provided with two ports for separate inlet and outlet of fuel. A first port is used as an inlet port to refuel the tank and a second port is used as an outlet port to refuel the following tank. The inlet port is connected to the outlet port and fluid may be transferred directly between the inlet port and the outlet port. A refueling unit 282 is by means of a refueling line 280 connected to the inlet port 471 of the OT-valve 234*a* of the first tank 222*a*. The outlet port 472 of the OT-valve 234*a* of the first tank 222*a* is by means of a line 244*a* connected to the inlet port 471 of the OT-valve 234*b* of the second tank 222*b*. The outlet port 472 of the OT-valve 234*b* of the second tank 222*b* is by means of a line 244*b* connected to the inlet port 471 of the OT-valve 234*c* of the last tank 222*c*. The outlet port 472 of the OT-valve 234*c* of the last tank 234*c* is by means of a supply line 232 connected to a fuel using unit 260, e.g. a fuel tank. Herein, the term "last tank" defines a tank of at least two serially connected tanks that is nearest connected to a fuel receiving unit.

In FIG. 1 is shown that in a system according to U.S. Pat. No. 7,426,935 each dependent tank requires a T-fitting. Thus, in such a system comprising three tanks, ten fittings is required whereas in a connected in parallel system according to the invention shown in FIG. 2A only six fittings are required.

Figure 2B:
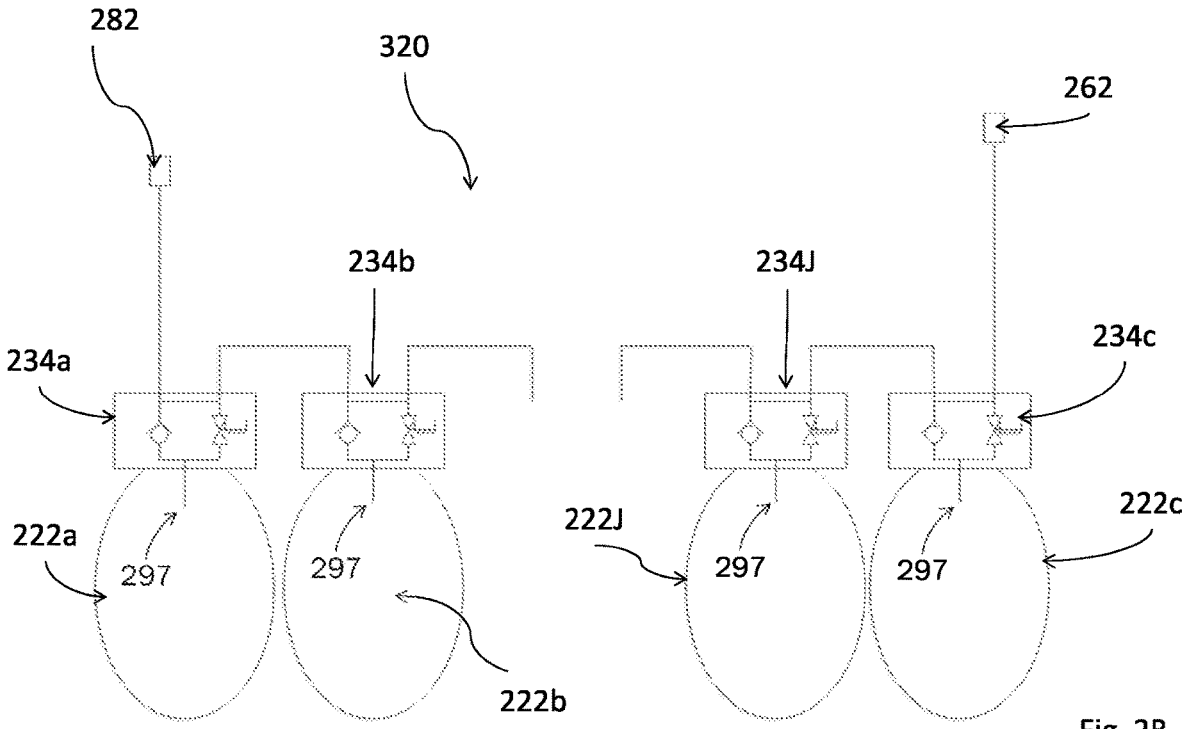
FIG. 2B illustrates further embodiments of the invention.

FIG. 2B illustrates a plan view of a system 320 according to the invention comprising several tanks, a first tank 222*a*, a second tank 222*b*, . . . , further tanks 222*j*, a last tank 222*c*, each provided with an OT-valve, a first OT-valve 234*a*, a second OT-valve 234*b*, . . . , a further OT-valve 234*j*, a last OT-valve 234*c* of the type illustrated in FIG. 4. A refueling unit 282 is by means of a refueling line 280 connected to the inlet port 471 of the OT-valve 234*a* of the first tank 222*a*. The outlet port 472 of the OT-valve 234*a* of the first tank 222*a* is by means of a line 244*a* connected to the inlet port 471 of the OT-valve 234*b* of the second tank 222*b*. The outlet port 472 of the OT-valve 234*b* of the second tank 222*b* is by means of a line connected to the inlet port of the OT-valve another tank (not shown in the figure). The outlet port of the OT-valve 234*j* of the tank 222*j* is connected to the inlet port of the last tank (222*c*). The outlet port 472 of the OT-valve 234*c* of the last tank 234*c* is by means of a supply line 232 connected to a fuel using unit 260, e.g. a fuel tank. In FIG. 2B, four tanks are shown, but a man in the art understands that more than four tanks may be connected in series in the same way.

FIG. 3 illustrates an OT-valve 146, 148 used in the system 120 shown in FIG. 1. A first line 157 and a second line 197 are connected to the OT-valve. The first line 157 is an inlet/outlet line to the OT-valve. The second line 197 connects the OT-valve to a dependent tank 224, 226 (shown in FIG. 1). The OT-valve comprises a check-valve 351 and a shut-off valve 352 connected in parallel. A check-valve allows flow in only one way. A shut-off valve is designed to open and close the path supplying function.

FIG. 4 illustrates an OT-valve 234*a*, 234*b*, 234*c* used in the system 220 according to the invention shown in FIG. 2A or 2B. It comprises a check-valve 451 connected in parallel with a shut-off valve 452. It differs from the OT-valve shown in FIG. 3 in that it has two ports for inlet and outlet of a fluid, i.e. an inlet port 471 and an outlet port 472, which are also connected to each other by means of a communication line 475. As the valve in FIG. 3, the OT-valve in FIG. 4 is provided with a unique line 297 that leads into the tank 222*a*, 222*b*, 222*c*. The function of the check-valve 451 in the OT-valve is to allow the flow only into the tank and to hinder the flow in the return direction.

Figure 5:
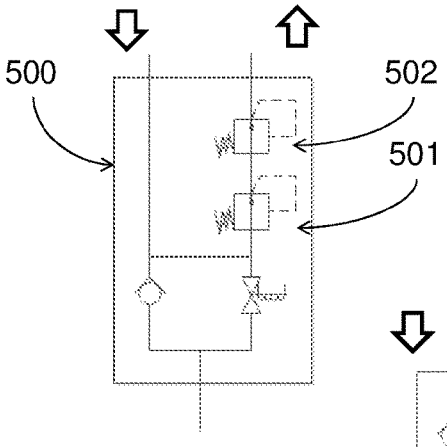
FIG. 5 shows an OT-valve provided with a pressure regulator used in a fuel tank system according to the invention.

FIG. 5 illustrates another OT-valve 500 which is connected to the last tank in a further embodiment of the invention. This OT-valve comprises two pressure regulators 501, 502, the function of which is to reduce the pressure of the fuel in two steps before it is fed to the fuel using unit. It should be noted that there may be only one or more than two pressure regulators.

Figure 6:
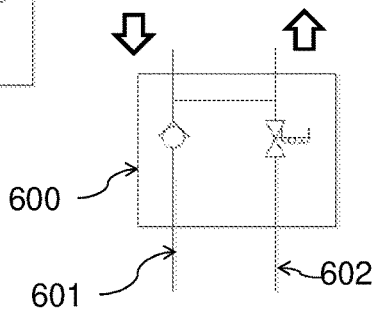
FIG. 6 shows a further OT valve used in a fuel tank according to the invention.

FIG. 6 illustrates a further OT-valve 600 which is connected to a tank in a further embodiment of the invention. The OT-valve 600 differs from the OT-valve in FIG. 4 in that it is provided with a first and a second communication line 601, 602 leading into the tank. The first communication line 601 can be used as an injector for refueling. Such an arrangement has the advantage to optimize the flow into the tank. The second communication line 602 can be used for the supply of a gas out of the tank. A filter may be added to the second communication line in order to absorb pollutants in the tank, e.g. pollutants that remains from the manufacture of the tank.

The invention claimed is:

1. A system for storing a gas, the system comprising at least two tanks, a first tank and a last tank, the first tank comprising an inlet port connected to a system inlet, the last tank comprising an outlet port connected to a system outlet, each tank being provided with an on tank valve comprising an inlet port, an outlet port, and a communication line leading into the tank, each on tank valve comprising a communication line between the inlet port and the outlet port of the on tank valve, the outlet port of the on tank valve of the first tank being connected to the inlet port of the on tank valve of the last tank, the at least two tanks being serially connected, wherein at least one on tank valve comprises at least one shut-off valve and one check-valve that are connected in parallel and link the inlet port and the outlet port to the inside of the tank to which the on tank valve belongs.

2. The system for storing a gas according to claim 1, the system comprising at least one further tank connected between the first tank and the last tank and provided with an on tank valve comprising an inlet port, an outlet port, and a communication line leading into the tank, each on tank valve comprising a communication line between the inlet port and the outlet port of the on tank valve, the inlet port of each tank being connected to outlet port of a previous tank, all tanks being serially connected.

3. The system for storing a gas according to claim 1, wherein the stored gas being natural gas or hydrogen gas.

4. The system according to claim 1, comprising at least one pressure regulator that is connected on a line inside the last tank, leading to the fuel receiving unit, or is built in the on tank valve of the last tank and connected in series with the shut-off valve in the on tank valve of the last tank.

5. The system according to claim 1, wherein at least one on tank valve comprises at least one of the following components: an excess flow valve, a filter, a safety venting device, a sensor.

6. The system according to claim 1, wherein at least one on tank valve is provided with a first and a second communication line leading into the tank.

7. The system according to claim 1, wherein the fuel using unit is a fuel cell tank.

8. A system for storing a gas, the system comprising at least two tanks, a first tank and a last tank, the first tank comprising an inlet port connected to a system inlet, the last tank comprising an outlet port connected to a system outlet, each tank being provided with an on tank valve comprising an inlet port, an outlet port, and a communication line leading into the tank, each on tank valve comprising a communication line between the inlet port and the outlet port of the on tank valve, the outlet port of the on tank valve of the first tank being connected to the inlet port of the on tank valve of the last tank, the at least two tanks being serially connected, wherein at least one on tank valve comprises at least one shut-off valve and one check-valve that are connected in parallel and link the inlet port and the outlet port to the inside of the tank to which the on tank valve belongs, and wherein the on tank valve is provided with a first and a second communication line leading into the tank.

* * * * *